US006614188B1

(12) United States Patent
Lindhout et al.

(10) Patent No.: US 6,614,188 B1
(45) Date of Patent: Sep. 2, 2003

(54) HIGH-PRESSURE DISCHARGE LAMP

(75) Inventors: Willem Johannes Lindhout, Turnhout (BE); Mark Josephus Lucien Maria Van Dommelen, Turnhout (BE); Guido Julianus Josephus Lenaerts, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 297 days.

(21) Appl. No.: 09/716,905

(22) Filed: Nov. 20, 2000

(30) Foreign Application Priority Data

Nov. 22, 1999 (EP) ..... 99203895

(51) Int. Cl.[7] ..... H01J 17/04

(52) U.S. Cl. ..... 313/633; 313/631; 313/567; 313/574

(58) Field of Search ..... 313/567, 574, 313/631, 633, 311, 566, 630

(56) References Cited

U.S. PATENT DOCUMENTS

| | | | | |
|---|---|---|---|---|
| 4,443,738 A | * | 4/1984 | Roy | 313/491 |
| 4,758,759 A | | 7/1988 | Scholz et al. | 313/46 |
| 5,173,632 A | * | 12/1992 | Dolan et al. | 313/25 |
| 5,986,404 A | * | 11/1999 | Dietze | 313/623 |

FOREIGN PATENT DOCUMENTS

| | | | |
|---|---|---|---|
| EP | 0890976 A2 | 1/1999 | H01J/61/34 |
| WO | WO0048230 | 8/2000 | H01J/61/34 |

* cited by examiner

*Primary Examiner*—Robert H. Kim
*Assistant Examiner*—Jurie Yun

(57) ABSTRACT

A high-pressure discharge lamp employs an outer bulb that is provided with a lamp cap and surrounds a discharge vessel having a ceramic wall with a clearance. In the clear space, a conductor extends over a length L between the lamp cap and an electrode of the discharge vessel, which conductor is at least formed of a heat-resistant metal. A section Ld of the length L of the conductor is provided with an Ni coating.

4 Claims, 1 Drawing Sheet

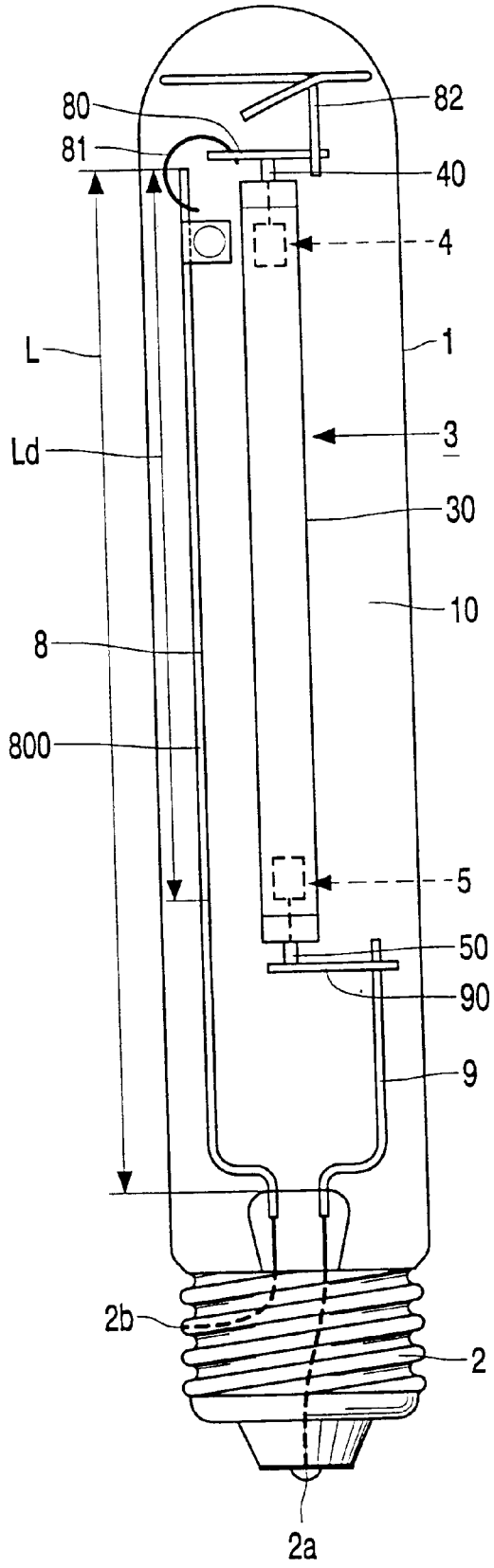
80
81
82
40
4
L
1
Ld
3
30
10
8
800
5
50
90
9
2b
2
2a

HIGH-PRESSURE DISCHARGE LAMP

BACKGROUND OF THE INVENTION

1. Field of the Invention

The present invention relates to a high-pressure discharge lamp employing an outer bulb, which is provided with a lamp cap and surrounds a discharge vessel having a ceramic wall with a clearance, an electric conductor extending in the clear space over a length L between the lamp cap and an electrode of the discharge vessel, and the conductor being predominantly made of stainless steel.

2. Description of the Related Art

A lamp known in the prior art is disclosed in U.S. Pat. No. 4,758,759. Such a lamp, embodied so as to be a high-pressure sodium lamp, is used, for example, on a large scale for public lighting applications. In an embodiment wherein the lamp comprises metal halide, it is particularly suitable as a light source for interior lighting. Ceramic wall is to be taken to mean in this description and the claims, both a wall of a gastight light-transmitting metal oxide, such as sapphire or densely sintered polycrystalline $Al_2O_3$, as well as a wall of metal nitride, such as AlN. Stainless steel is to be taken to mean in this description and the claims, both Cr-alloyed ferritic steel and Cr and Ni-alloyed austenitic steel which is resistant to temperatures of 500° C. and higher.

The discharge vessel of the known lamp employs two inner electrodes between which a discharge takes place during operation of the lamp. Each electrode is electrically connected to the lamp cap by a conductor. The conductors generally also form a part of the suspension of the discharge vessel. Suitable constructions enable Ni-plated iron to be used. However, this has the drawback that the necessary constructions are fairly complex and heavy. Another drawback resides in that Ni-plated iron has a small residual strength as a result of which it proves unsuitable for use in simpler and lighter constructions wherein the conductor is embodied so as to be self-supporting. The aforementioned drawbacks can be obviated by using stainless steel. However, in practice, stainless steel gives rise to blackening of the outer bulb, which is a disadvantage.

SUMMARY OF THE INVENTION

It is an object of the invention to provide a high pressure discharge lamp that obviates the aforementioned drawbacks with the prior art. To achieve this, a high pressure discharge lamp in accordance with the invention comprises a conductor with an Ni coating over at least a part Ld of a length L of the conductor.

It has been found that said Ni coating is a suitable for counteracting blackening and, on the other hand, it enables the conductor to be readily weldable. The latter is in sharp contrast with, for example, a coating of Cr oxide, known per se, which leads to a poor weldability of the metal conductor. In addition, the high temperature generally required for applying such a coating readily leads to an undesirable reduction of the residual strength of the conductor in question.

Preferably, the part Ld of the conductor where the coating is present, extends along the discharge vessel. The part Ld is the portion of the conductor that reaches a maximum temperature during operation of the lamp.

In a further, advantageous embodiment of the lamp in accordance with the invention, the conductor is made from ferritic stainless steel. An important advantage of ferritic steel is that only a comparatively small temperature increase is required to apply the Ni coating, as a result of which the ferritic steel preserves sufficient residual strength and hence largely preserves its self-supporting capacity. In addition, the nickel-coated ferritic stainless steel can be readily welded. Preferably, the Ni coating forms a layer that encloses the conductor. With a view to a reproducible, industrial-scale manufacture of the lamp in accordance with the invention, the layer advantageously has a thickness of at least 3 $\mu$m.

BRIEF DESCRIPTION OF THE DRAWING

These and other aspects of the invention will be apparent from and elucidated with reference to a drawing of an example of a lamp in accordance with the invention.

DETAILED DESCRIPTION OF THE INVENTION

The drawing shows a high-pressure discharge lamp comprising an outer bulb 1 having a lamp cap 2 and surrounding a discharge vessel 3 with a clearance 10, which discharge vessel 3 has a ceramic wall 30, an electric conductor 8 extending in said clear space over a length L between the lamp cap 2 and an electrode 4 of the discharge vessel 3. The conductor 8 is predominantly made of stainless steel. In accordance with the invention, said conductor 8 is provided over at least a part Ld of the length L with an Ni coating. In the case described herein, 800 represents the part Ld of the conductor 8 which is provided with the Ni coating. Said part 800 extends along the discharge vessel Electrode 4 is an inner electrode. The discharge vessel additionally comprises a further inner electrode 5. During operation of the lamp, a discharge extends between the two inner electrodes 4, 5 of the discharge vessel. Electrode 4 is electrically connected to an element 80 by means of a lead-through member 40. An electroconductive wire 81 forms an electric connection between the conductor 8 and the element 80. A support spring 82 which is stayed by the outer bulb 1 is welded to the clement 80.

Electrode 5 is connected to an element 90 by means of a lead-through member 50. Element 90 too is connected, by means of a weld, to a further conductor 9. The conductors 8, 9 are electrically connected, in a manner which is known per se, to a contact point 2*a* and 2*b*, respectively, of the lamp cap 2.

A practical embodiment of the above-described lamp relates to a high-pressure sodium lamp having a rated power of 600 W. The conductors 8 and 9 are made from ferritic stainless steel, type AISI 430. The portion Ld of the conductor 8 extending along the discharge vessel is provided with a tight Ni coating enveloping the conductor, said coating having a thickness in the range between 5 $\mu$m and 12 $\mu$m. After 2000 burning hours, the luminous efficacy of the lamp is 95% of the luminous efficacy at the beginning of the service life. For comparison, the luminous efficacy of a similar lamp, yet without an Ni coating on the conductor, is measured. Already after 1500 hours, the luminous efficacy has decreased to 90%, and blackening of the outer bulb is clearly visible.

In an alternative embodiment of the lamp, the conductor 8 is provided with an Ni coating over the whole length L. In a further modification, the conductors are made from austenitic stainless steel.

The scope of protection of the invention is not limited to the above-described embodiments. The invention is embodied in each novel characteristic and each combination of characteristics. The use of the verb "to comprise" and its conjugations does not exclude the presence of elements or steps other than those stated in the claims. The use of the article "a" or "an" in front of an element does not exclude the presence of a plurality of such elements.

What is claimed is:

1. A high-pressure discharge lamp, comprising:

a discharge vessel;

an outer bulb surrounding said discharge vessel with a clearance;

an electric conductor extending within the clearance between said outer bulb and said discharge vessel, wherein said conductor is made from ferritic stainless steel and is provided with a Ni Coating over a least a portion of said conductor.

2. The high-pressure discharge lamp of claim 1, wherein the at least a portion of said conductor extends along said discharge vessel.

3. The high-pressure discharge lamp of claim 1, wherein said Ni coating forms a layer that encloses the at least a portion of said conductor.

4. The high-pressure discharge lamp of claim 3, wherein said Ni coating has a thickness of at least 3 $\mu$m.

* * * * *